US005896760A

United States Patent [19]

Osburn

[11] Patent Number: 5,896,760

[45] Date of Patent: Apr. 27, 1999

[54] TOOL FOR MOUNTING A DOOR LOCK ASSEMBLY

[76] Inventor: H. Scott Osburn, 4121 Custis Rd., Richmond, Va. 23225

[21] Appl. No.: 08/870,207

[22] Filed: Jun. 6, 1997

[51] Int. Cl.[6] ..... B25B 1/10; E05B 17/00

[52] U.S. Cl. ..... 70/19; 70/370; 70/466; 269/219; 269/221; 269/249; 269/269; 269/270

[58] Field of Search ..... 70/465, 466, 451, 70/DIG. 32, 370, 19; 269/249, 221, 219, 268, 269, 270; 33/197; 292/DIG. 64, DIG. 53; 408/103

[56] References Cited

U.S. PATENT DOCUMENTS

| | | | |
|---|---|---|---|
| 59,861 | 3/1866 | Ormsby | 269/219 |
| 62,584 | 3/1867 | Williams et al. | 269/269 |
| 166,141 | 7/1875 | Prindle | 269/269 |
| 1,611,930 | 12/1926 | MacLeod | 70/466 |
| 1,713,239 | 5/1929 | Parkhurst | 269/219 |
| 1,912,313 | 5/1933 | Schwab | 269/269 |
| 2,594,794 | 4/1952 | Mull | 269/219 |
| 2,886,080 | 5/1959 | Rappeport | 269/219 |
| 3,131,927 | 5/1964 | Penix | 269/219 |
| 3,218,058 | 11/1965 | Smith | 269/254 R X |
| 4,306,823 | 12/1981 | Nashlund | 408/26 |
| 4,715,125 | 12/1987 | Livick | 33/197 |
| 4,813,826 | 3/1989 | Riedel | 408/108 |
| 5,081,771 | 1/1992 | McGregor et al. | 33/667 |
| 5,116,170 | 5/1992 | Palmer et al. | 408/72 B |
| 5,222,845 | 6/1993 | Goldstein et al. | 408/103 |
| 5,479,802 | 1/1996 | Miller | 70/466 X |
| 5,489,088 | 2/1996 | Warter | 269/249 X |

FOREIGN PATENT DOCUMENTS

| | | | |
|---|---|---|---|
| 139929 | 11/1949 | Australia | 269/219 |
| 7852 | of 1906 | United Kingdom | 269/219 |

*Primary Examiner*—Lloyd A. Gall
*Attorney, Agent, or Firm*—Norman B. Rainer

[57] ABSTRACT

A tool for holding an exterior hub component of a dead bolt door lock within a cylinder bore extending between interior and exterior surfaces of a door includes first and second flat rigid plates elongated between proximal and distal extremities, and a securing mechanism interactive between both plates adjacent their proximal extremities. The distal extremity of the first plate is provided with an arcuate recess configured to embrace the cylinder bore. In use, the first plate is caused to lie flush against the interior surface of the door while the second plate rests atop the exterior hub positioned within the cylinder bore, and forces the hub toward the door.

9 Claims, 3 Drawing Sheets

TOOL FOR MOUNTING A DOOR LOCK ASSEMBLY

BACKGROUND OF THE INVENTION

1. Field of the Invention

This invention relates to a holding tool for enabling rapid mounting of a dead bolt lock assembly to a door.

2. Description of the Prior Art

Hinged type doors, in preparation for receiving dead bolt lock assemblies, are provided with a cylinder bore extending between both sides of the door. The cylinder bore is closely adjacent the edge of the door and typically has a diameter of about 2 ⅛ inches. A horizontally disposed plunger bore is also provided, communicating between the edge of the door and the cylinder bore. The plunger bore accommodates a latching bolt assembly having a bolt that projects to the door frame and seats in a recess when the door is closed and retracts into the door in response to the turning of a key or handle when the door needs to be opened.

The dead bolt lock is further comprised of interior and exterior circular hubs, each equipped with a key-operated pin-tumbler cylinder. The two cylinders are axially aligned and have torque blades that enter a crank sleeve in said latching bolt assembly. The torque blades produce rotative movement of the crank sleeve, which in turn produces reciprocating lateral movement of the latch bolt. When properly assembled, the two hubs are interengaged by two machine screws that draw the hubs together in embracing relationship upon the door. The machine screws enter the interior hub at diametrically opposed sites, and are inaccessible from the exterior hub.

When mounting the lock assembly to the door, the latch bolt assembly is emplaced within the plunger bore, the exterior hub is then inserted into the cylinder bore from the exterior surface of the door, and the interior hub is lastly entered into the opposite extremity of the cylinder bore. The interior hub, having two spaced apart holes for receiving said machine screws, is aligned with threaded receiving sockets in the exterior hub. Also, the torque bars of both hubs must be caused to engage the crank sleeve of the bolt assembly. The machine screws are passed through the holes in the interior hub and into engagement with threaded receiving sockets in the exterior hub.

However, the insertion and engagement of the machine screws and torque bars is difficult because the interior and exterior hub components of the lock set must be held together in aligned facing relationship within the cylinder bore while the machine screws and torque bars are manipulated.

Devices which facilitate the mounting of door locks are disclosed in numerous U.S. Patents, including: U.S. Pat. Nos. 4,306,823; 4,715,125; 4,813,826; 5,081,771; 5,116,170; and 5,222,845. However, such devices are generally concerned with techniques for drilling the two holes required for the accurate installation of the lock assembly. None address the problem of holding the lock components in place during assembly and mounting.

Although a device for holding the lock components during assembly and mounting can be of repeated service to a professional carpenter or other craftsman, in many instances the device would be used just once with the purchase of a door lock assembly, then discarded.

It is accordingly an object of the present invention to provide a holding tool for aiding the installation of a dead bolt door lock.

It is another object of this invention to provide a tool as in the foregoing object which is of sufficiently compact size to permit packaging along with a door lock set.

It is a further object of the present invention to provide a holding tool of the aforesaid nature which is quick and easy to use.

It is a still further object of this invention to provide a holding tool of the aforesaid nature which is of simple construction and amenable to manufacture at sufficiently low cost to justify one-time use.

These objects and other objects and advantages of the invention will be apparent from the following description.

SUMMARY OF THE INVENTION

The above and other beneficial objects and advantages are accomplished in accordance with the present invention by a tool for holding an exterior hub component of a dead bolt door lock within a cylinder bore extending between interior and exterior surfaces of a door, said tool comprising:

a) first and second flat rigid plates elongated between proximal and distal extremities, said first plate adapted to engage said interior door surface and having an arcuate recess which opens onto said distal extremity, said second plate adapted to engage said exterior hub and urge it toward said door, and b) securing means adjacent said proximal extremities and interactive between said plates in a manner to adjustably position said plates in spaced apart parallel relationship while applying axially directed force upon said exterior hub.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
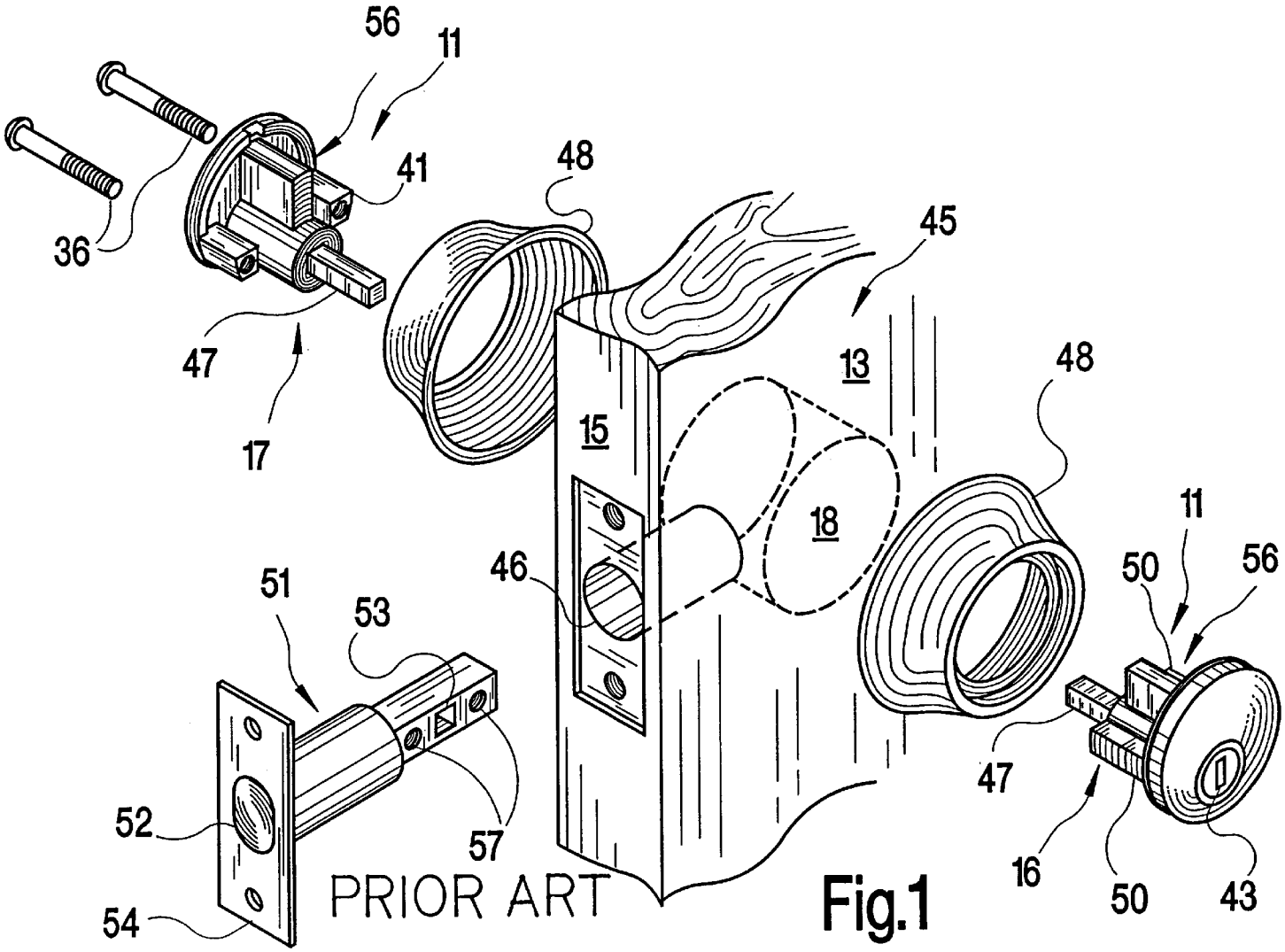
FIG. 1 an exploded perspective view of a conventional dead bolt lock assembly.

Referring to FIG. 1, a dead bolt lock assembly 11 of conventional design is shown in its usual manner of installation onto a swinging door 45 having an interior surface 14, exterior surface 13, and edge surface 15. The door is provided with a cylinder bore 18 extending orthogonally between said interior and exterior surfaces, and a horizontally disposed plunger bore 46 communicating between edge surface 15 and cylinder bore 18.

The lock assembly is comprised of interior and exterior circular hub components 17 and 16, respectively. Each hub component is separately comprised of a cylinder lock assembly 56, key slot 43, torque blade 47 and housing collar 48. Two machine screws 36 enter holes 41 in interior hub 17, and engage threaded sockets 50 in exterior hub 16.

A latch bolt assembly component 51 of the lock assembly is emplaced within plunger bore 46. The latch bolt assembly is comprised of bolt 52, rotative crank sleeve 53 which activates reciprocating lateral motion of bolt 52 by way of an internal cam action, and face plate 54. Two securing holes 57 are provided for penetratively receiving machine screws 36.

Figure 2:
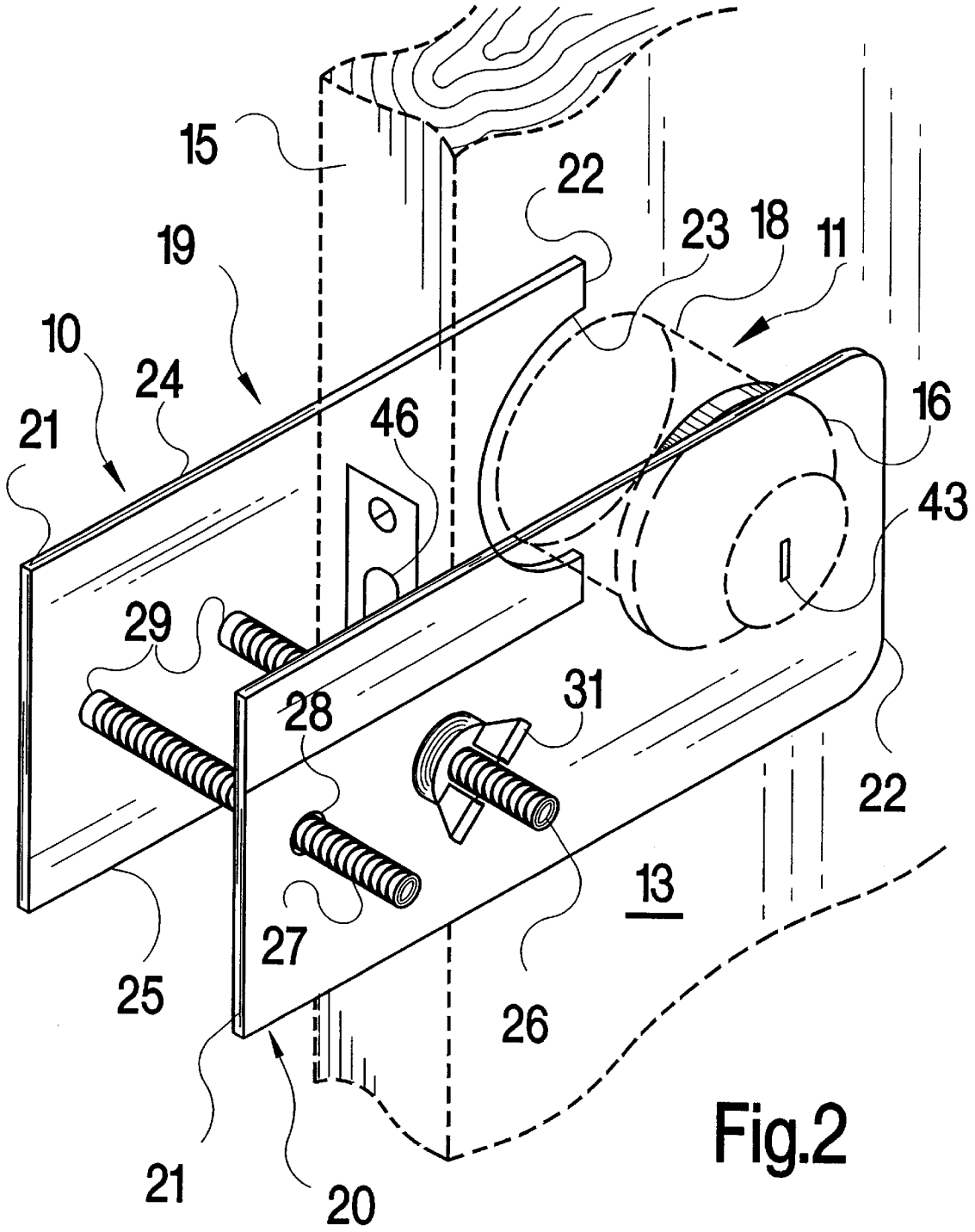
FIG. 2 is a perspective view of an embodiment of the holding tool of the present invention shown in operative association with components of a dead bolt lock in a door.
Figure 3:
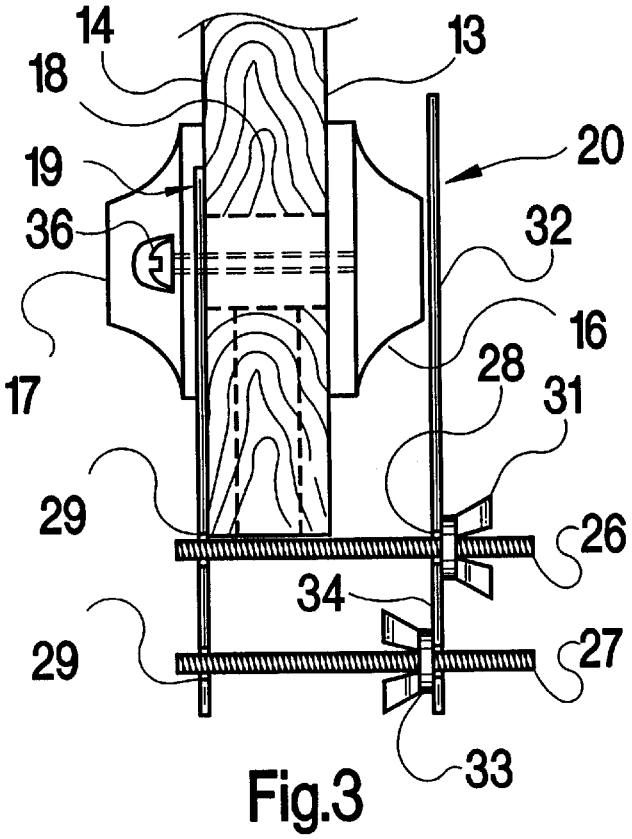
FIG. 3 is a top view of the embodiment of FIG. 2.
Figure 4:
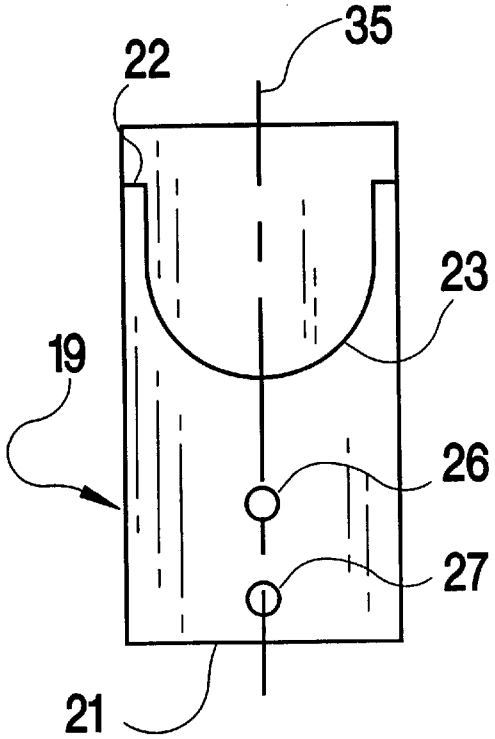
FIG. 4 is a side view taken from the left of FIG. 2.
Figure 6:
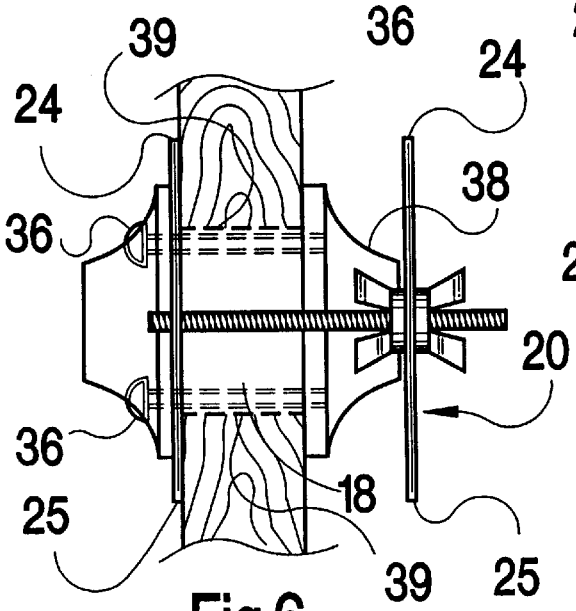
FIG. 6 is an end view.
Figure 5:
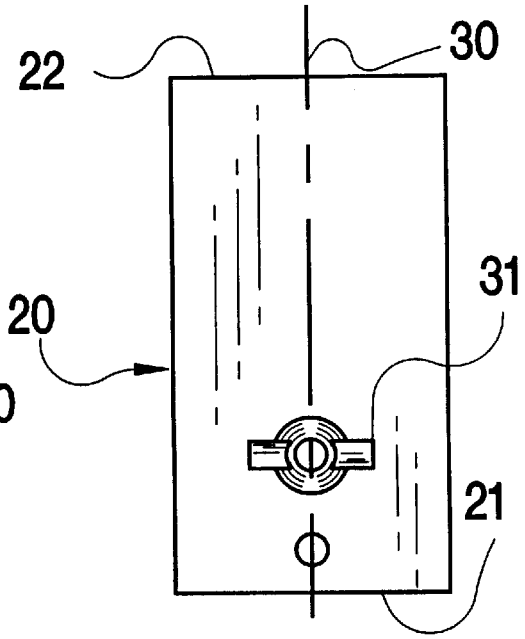
FIG. 5 is a side view taken from the right of FIG. 2.

Referring to FIG. 2, an embodiment of the holding tool 10 of the present invention is shown in operative association with exterior circular hub component 16 disposed in its initial emplacement within cylinder bore 18.

As shown more clearly in FIGS. 2–6, holding tool 10 is comprised of first and second flat rigid plates 19 and 20, respectively, each elongated between rear proximal and forward distal extremities 21 and 22, respectively. The plates are of thin metal construction, preferably fabricated of steel or heat-tempered aluminum. First plate 19 has an arcuate recess 23 which opens onto its distal extremity 22. The size and shape of recess 23 is such as to embrace interior hub 17.

The illustrated plates 19 and 20 are of generally rectangular shape, bounded in part by top and bottom straight edges 24 and 25 respectively. The length of the plates, measured between distal and proximal extremities, may range from about 4 to 9 inches, and the width of the plates, measured between said top and bottom edges, may range from about 3 to 5 inches.

Securing means comprised in part of forward and rearward threaded rods 26 and 27, respectively, are disposed adjacent the proximal extremities of plates 19 and 20. Said rods threadably engage threaded apertures 29 in first plate 19, and slidably pass through close fitting apertures 28 in second plate 20. However, the rods may alternatively threadably engage said second plate and pass through said first plate. Said apertures 28 and 29 in the separate plates are located on the bisecting mid-line axis 30 of each plate and are equally spaced apart, causing the two pairs of holes to be in congruent superimposed relationship.

A first threadably advanceable adjustment means in the form of wing nut 31 engages forward rod 26 and acts upon the outside surface 32 of second plate 20 in a manner to cause convergence of the two plates. A second threadably advanceable adjustment means in the form of wing nut 33 acts upon the inside surface 34 of said second plate in a manner to cause divergence of the two plates. Such arrangement of components of the exemplified securing means enables the plates to clamp onto any intervening object in a vise-like manner. In particular, when both wing nuts are tightened against the opposite surfaces of second plate 20, both plates become locked in stable position in opposing relationship, and securely grip any object disposed between the plates in contacting relationship therewith. It is also to be noted that the exemplified embodiment of the holder tool of this invention has a plane of symmetry 35 that contains the mid-line axis 30 of each plate.

In a typical use, the holding tool is placed over the edge surface 15 of a door such that forward threaded rod 26 may abut against said edge surface, and recess 23 embraces cylinder bore 18, while second plate 20 rests atop the exterior hub 16, loosely seated within cylinder bore 18. The wing nuts are then adjusted so that exterior hub 16 is secured upon the axis of said cylinder bore with key slot 43 vertically aligned, and torque blade 47 enters crank sleeve 53 of the latch bolt assembly. While the exterior hub is thereby immobilized, the interior hub can be easily and accurately installed. Such installation involves engagement of torque blade 47 with crank sleeve 53 and passage of machine screws 36 through holes 41 in the interior hub, through securing holes 57 in the bolt assembly, and into engagement with threaded sockets 50 of exterior hub 16. In such manner of use, it is preferable that the distal extremity of plate 20 extend forwardly of the distal extremity of plate 19. The purpose for such configuration is that, whereas plate 19 contacts the interior surface 14 of the door in embracing relationship with said cylinder bore, plate 20 is adapted to overlie opposing hub 16.

When not in use, the holder tool can be dismantled into its separate parts. Because the separate parts are of flat or low profile contour, the dismantled tool occupies very little space, and can be easily packaged with a specific door dead bolt assembly, and sold therewith in a single package.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A tool for holding a door lock assembly within a cylindrical bore extending between interior and exterior surfaces of a door, said assembly having an interior hub configured to protrude from said interior surface, and an exterior hub configured to protrude from said exterior surface, said tool compromising:

a) first and second flat rigid plates elongated between proximal and distal extremities, said first plate adapted to lie flat against said interior door surface and having an arcuate recess which opens onto its distal extremity, the size and shape of said recess being such as to embrace said interior hub, each plate having a bisecting mid-line axis and two spaced apart apertures centered upon said axis, said second plate configured to engage said exterior hub and force it toward said door, and b) securing means adjacent said proximal extremities and interactive between said plates in a manner to adjustably position said plates in spaced apart parallel relationship while applying said force upon said exterior hub, said securing means being comprised in part by forward and rearward threaded rods which threadably engage said apertures in one of said plates, and slidably pass through said apertures in the other plate, c) the construction-of said tool being such that, when dismantled, the separate components are of low profile construction, enabling the dismantled tool to occupy very little space for packaging purposes.

2. The tool of claim 1 wherein said plates are of generally rectangular shape, bounded in part by top and bottom straight edges.

3. The tool of claim 2 wherein the width of said plates, measured between said top and bottom edges, is between 3 and 5 inches.

4. The tool of claim 1 wherein the length of said plates, measured between said distal and proximal extremities, is between 4 and 9 inches.

5. The tool of claim 1 wherein said second plate is further characterized in having an outside surface and an inside surface that faces said first plate.

6. The tool of claim 5 wherein a first threadably advanceable adjustment means engages said forward rod and acts upon the outside surface of said second plate in a manner to cause convergence of the two plates, and a second threadably advanceable adjustment means engages said rearward rod and acts upon the inside surface of said second plate in a manner to cause divergence of the two plates.

7. The tool of claim 6 wherein said advanceable adjustment means are wing nuts.

8. The tool of claim 1 having a plane of symmetry that contains the mid-line axis of both plates.

9. A method for mounting a door lock assembly onto a door having interior and exterior surfaces and a cylindrical bore fashioned in said door for the purpose of accommodating said lock assembly, said bore extending between said interior and exterior surfaces, said lock assembly comprising a component having opposed alignable interior and exterior hubs, and parts for aligning and securing said lock assembly, said method comprising:

a) inserting said component into said cylindrical bore in a manner whereby said interior and exterior hubs protrude from said interior and exterior door surfaces, respectively, b) clamping said component by utilizing the tool of claim 1 in a manner to force said exterior hub against said exterior door surface while permitting free access to said interior hub, and c) installing said parts to achieve alignment and securement of said hubs.

* * * * *